US006880732B2

(12) United States Patent
Scheindel

(10) Patent No.: US 6,880,732 B2
(45) Date of Patent: Apr. 19, 2005

(54) PISTON FOR PRESSURIZED CONTAINER

(76) Inventor: Christian T. Scheindel, 2065 Ridge Rd., Randolph Center, VT (US) 05061

( * ) Notice: Subject to any disclaimer, the term of this patent is extended or adjusted under 35 U.S.C. 154(b) by 29 days.

(21) Appl. No.: 10/457,228

(22) Filed: Jun. 9, 2003

(65) Prior Publication Data

US 2004/0134929 A1 Jul. 15, 2004

Related U.S. Application Data

(60) Provisional application No. 60/440,211, filed on Jan. 15, 2003.

(51) Int. Cl.[7] ..... B67D 5/42

(52) U.S. Cl. ..... 222/387; 222/386; 222/389; 222/1

(58) Field of Search ..... 222/1, 386, 387, 222/389

(56) References Cited

U.S. PATENT DOCUMENTS

| | | | | |
|---|---|---|---|---|
| 2,895,650 A | | 7/1959 | Mahon et al. | |
| 3,255,936 A | | 6/1966 | Healy et al. | |
| 4,355,736 A | | 10/1982 | Schumacker et al. | |
| 4,533,069 A | * | 8/1985 | Drobish | 222/209 |
| 4,913,323 A | * | 4/1990 | Scheindel | 222/386 |
| 5,360,146 A | | 11/1994 | Ikushima | |
| 5,419,466 A | * | 5/1995 | Scheindel | 222/389 |
| 5,441,181 A | * | 8/1995 | Scheindel | 222/389 |

FOREIGN PATENT DOCUMENTS

| | | |
|---|---|---|
| FR | 2 781 210 | 1/2000 |

* cited by examiner

*Primary Examiner*—J. Casimer Jacyna
(74) *Attorney, Agent, or Firm*—Reed Smith LLP

(57) ABSTRACT

The structure of a piston design to be used in a pressurized dispensing container which dispenses product that is loaded at a higher temperature where it is highly flowable but maintained and dispensed at a lower temperature where it is highly viscous. The piston has an annular sidewall with an upper end that maintains a very close tolerance to the can in which it is used. The lower end has a smaller interference fit with the container. Between the upper and lower end is a recess zone that provides a more substantial clearance with the sidewall of the container.

23 Claims, 4 Drawing Sheets

PISTON FOR PRESSURIZED CONTAINER

REFERENCE TO RELATED APPLICATIONS

This application claims the priority of Provisional Application Ser. No. 60/440,211 filed on 15 Jan. 2003 and entitled: Piston For Pressurized Container.

BACKGROUND OF THE INVENTION

This invention relates in general to a piston for a pressurized container and more particularly to one that is adapted to be employed with a product, such as ice cream, whose flowability varies from a highly flowable state when being loaded into the can to a relatively rigid state when frozen and a somewhat intermediate flowable state when being dispensed.

Pressure operated dispensing containers which employ a piston that is longitudinally slidable within the container are known in the art. These pressurized containers are used to dispense a variety of different materials having different flowability characteristics and varying viscosities. The containers generally are a cylindrical can closed at the bottom end and having a dispensing nozzle and discharge valve at the upper end.

The piston within the container separates the interior of the container into two chambers. The product to be dispensed occupies the upper chamber and pressurized fluid, which acts as a propellant, occupies the lower chamber on the underside of the piston. The piston is generally in the form of an inverted cup and has an upper surface and an annular skirt or sidewall which extends down from the upper surface. The piston, and in particular its upper surface, acts as a barrier wall to separate the product from the propellant. The annular sidewall of the piston stabilizes and positions the piston in the container and provides the surface which rides on the inner wall of the container.

The product to be dispensed is loaded into the upper chamber of the container. After loading the product, an outlet valve is closed. Then propellant is charged into the lower chamber to create a pressure forcing the piston up against the product. When the valve at the top of the container is opened, the propellant pushes the piston towards the top of the container forcing the product to exit the container through the valve and nozzle.

After the container is loaded with product and the piston is pressurized, the piston sidewall and the inner surface of the can wall must maintain a relationship that serves the triple purpose of (a) permitting the piston to ride up as product is dispensed, (b) minimizing the amount of product that seeps down past the clearance between piston sidewall and can sidewall, and (c) minimizing the diffusion of propellant from below the piston around the sidewall into the product. Further, during the dispensing of product, it is important that the piston move smoothly to prevent blow-by of propellant that might occur if the piston sticks in place.

Pistons that Applicant has designed are disclosed in U.S. Pat. No. 4,913,323 issued Apr. 3, 1990 and U.S. Pat. No. 5,441,181 issued Aug. 15, 1995. These pistons, like other pistons known in the art, provide various trade-offs of piston movement, piston stability, ability to seal product from seeping into the pressure chamber and ability to prevent pressurized fluid from the pressure chamber leaking into the product. These trade-offs are in part affected by the nature of the product being dispensed. Product factors such as viscosity, the effect of the propellant on curing the product within the container and the requirement for product uncontaminated by propellant are co-factors in determining optimum piston design trade-offs.

Where a product, such as ice cream, is to be dispensed, the challenge is to provide a piston design which will meet the general objectives of a piston; that is, appropriate ability to move and push product during dispensing yet provide the required sealing between the top and bottom of the container in the context of a product that is loaded under pressure in a highly flowable fluid state and dispensed in a much less flowable state.

It is an object of this invention to provide a piston particularly adapted for use in a pressurized container that dispenses ice cream and similar products.

It is a related purpose to provide this function in a piston that can be readily and inexpensively molded in large quantities.

BRIEF DESCRIPTION

A piston that is adapted to be used in a pressurized dispensing container that dispenses such products as ice cream has an annular sidewall and an upper surface, thereby providing a piston having an inverted cup shape. The upper surface is configured to accommodate whatever valve is employed and to fit as much as possible the upper surface of the can so that the maximum amount of product can be dispensed.

The upper end of the piston sidewall has as small a clearance as possible to provide an effective seal yet avoid binding the piston in the container and thus avoid preventing the piston from riding up in the container under pressure. The lower end of the sidewall has a compressible zone that provides a very small interference fit to the sidewall of the container.

The intermediate zone, between the upper end and lower end, of the sidewall is recessed so as to provide a significant clearance (for example, 10 to 20 mils on a radius) between the piston sidewall and the inner surface of the container over most of the piston sidewall.

This intermediate zone recess, by avoiding any possible contact with the can wall, minimizes the total friction between piston and sidewall so that the clearance at the upper edge of the piston sidewall can be quite small (for example, 4 mils on a radius) and the bottom flexible end can have a small interference fit (for example, 3 to 5 mils on a radius). Thus the frictional engagement between piston and container sidewall occurs at these two ends. This mid sidewall recess also provides the advantage that whatever ice cream does seep down past the upper edge, during the process of loading the ice cream in the container and during the subsequent charging of pressure under the piston, is contained within the recess in a fashion that aids in sealing the lower end against propellant diffusion until product is frozen.

The compressible lower end, having a small interference fit aids in minimizing diffusion of propellant around the piston sidewall during charging of propellant.

BRIEF DESCRIPTION OF THE DRAWINGS

FIG. 1 shows the use of a ball type valve and illustrates the piston in its uppermost position. This is ideally the position that the piston would have after all product has been discharged.

In FIG. 5, a rib is adjacent to the base opening through which propellant is charged into the container.

Figure 1:
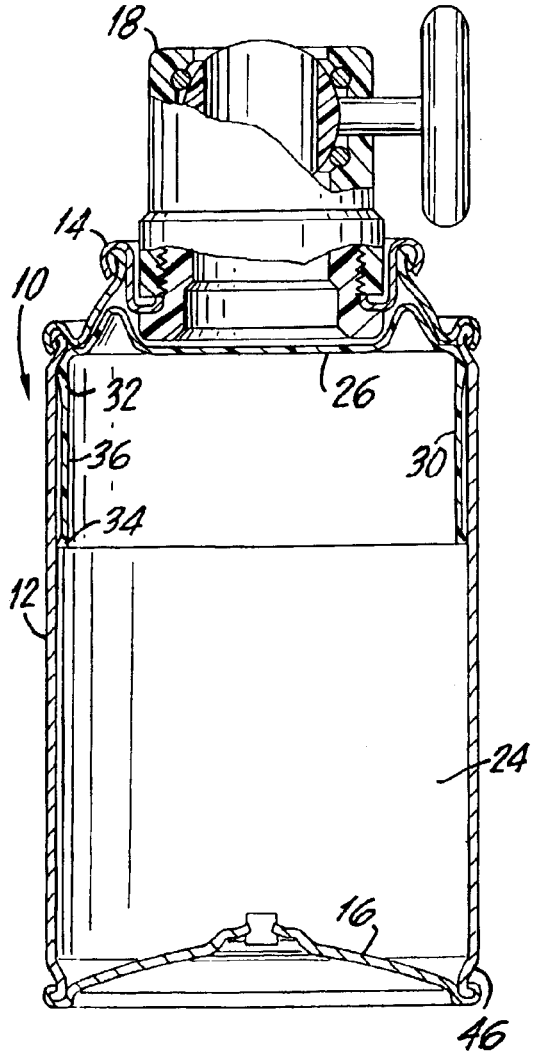
FIG. 1 is a schematic longitudinal sectional view, in partial relief of a first embodiment of the piston of this invention and the container in which it is to be used.
Figure 2:
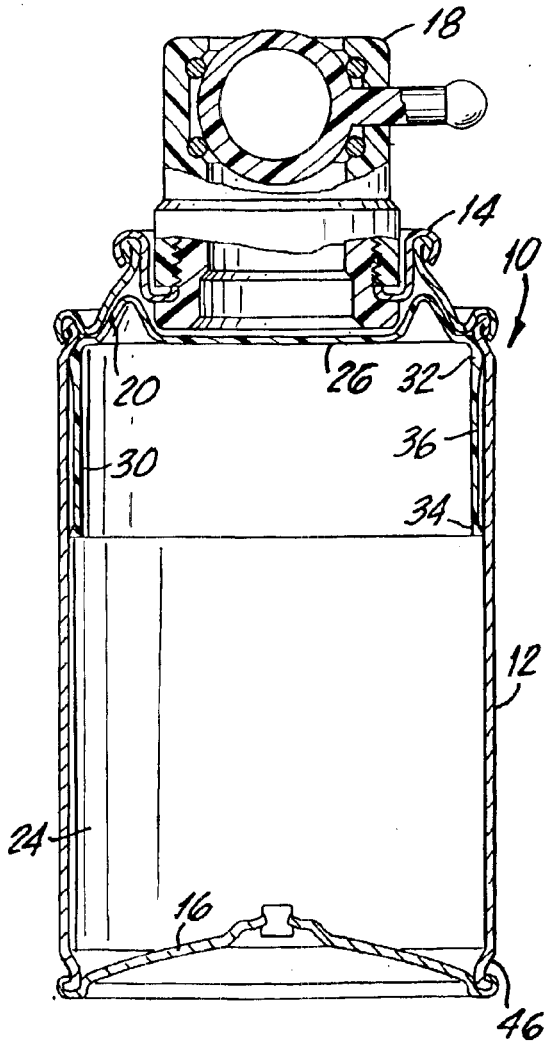
FIG. 2 is an illustration similar to that of FIG. 1 showing the ball valve in its closed position.

In the FIGS., the amount by which the piston sidewall 30 recesses between upper end 32 and lower end 36 is exaggerated in order to facilitate visualizing this critical dimensional relationship.

DESCRIPTION OF THE PREFERRED EMBODIMENTS

The container 10 has a sidewall 12, a top cap 14, a bottom wall 16. The container has a valve 18(in this case, a ball type valve) that when actuated will permit pressurized product in the can to be dispensed through the valve. FIGS. 1 through 4, illustrate a first embodiment of the piston 20 of this invention. The piston 20 separates the can into the product containing upper chamber 22 and a propellant containing lower chamber 24.

The upper surface 26 serves as a barrier between the product to be dispensed in the upper chamber 22 and the propellant in the lower chamber 24. There is a shallow well 28 in the upper surface 26, which surface is preferably one that matches the shape on the inner surface of the top cap 14.

The piston sidewall 30 has three significant zones; namely, a top edge 32, a bottom edge 34 and an intermediate recessed zone 36 which spans most the length of the sidewall 30.

The top edge 32 and the bottom edge 34 constitute a small percentage of the length of the sidewall 30. The top edge 32 has a diameter which provides a clearance of perhaps four thousands of an inch (4 mils) on a radius with the inner surface of the can sidewall 12. The bottom edge 34 has a small interference fit of perhaps three thousands of an inch (3 mils) on a radius with the container sidewall. The recessed zone 36 provides a gap that is approximately fifteen thousands of an inch (15 mils) on a radius with the container sidewall.

As a practical molding consideration, the outer surface of the recess 36 will taper from the dimensions at the top edge 32 and bottom edge 34.

The particular dimensions of one embodiment of this invention are set forth below. What is important to recognize is that the particular design is in part a function of the container to be used, the product to be dispensed and propellant employed.

The comments herein relate to the design considerations for adapting a piston of this invention to a particular environment; one in which an ice cream type product is dispensed.

It is important that the upper edge 32 be rigid to assure effective dispensing. It is important that the piston 30 be rigid to resist deforming under the pressure of loading the ice cream. Thus a piston having the rigidity of a polypropylene material is employed.

The wall thickness of the sidewall of the piston is approximately to 35 to 40 mils. This thickness, together with the use of polypropylene as the material for the piston, has the advantage of providing sufficient stiffness or rigidity or hoop strength at the upper corner.

The term "frozen" is used in a manner that is common in the industry to refer to the state of the product, in this case ice cream, when in the freezer. It should be understood that the physical nature of the product is not that of a crystal or solid. When ready for dispensing, the product has a type of viscosity or ability to flow that permits it to be pushed out of the valve 18 by the pressurized piston 20. Thus it is frozen only in the sense that it is materially different from the highly flowable product that is loaded into the container.

The preferred ice cream product is saturated with gas under pressure. In this case, nitrous oxide is used. The gas assures the desired flowability. The product with the saturated nitrous oxide has to be loaded into the can under pressure and at a temperature where it is something like a slurry and flows fairy readily. The can then has to be pressurized immediately, at which time the piston will maintain pressure so that the nitrous oxide will stay in solution. The temperatures and speed of the loading and pressurizing steps have to be determined by experiment and experience with each type of product and will be a function of a number of factors including temperature, type of product, loading procedure and pressurizing procedure, including speed of loading and pressurizing The stiffness of the piston is important when loading the ice cream under pressure into the container. The ice cream has to be loaded under pressure in order to keep the nitrous oxide ($N_2O$) in solution. It is a saturated or close to saturated solution of nitrous oxide under pressure dissolved in the ice cream. This nitrous oxide gives the ice cream flowability.

Because the ice cream product is loaded under pressure, it will force the piston down against the bottom of the container under considerable pressure (for example, 40 psig) during loading. The piston has to be able to maintain its form and shape and not distort under this pressure. Thus it has to have rigidity such as discussed above.

It is believed to be important during loading of product that the bottom edge of the piston be pressed against a bottom surface of the container to assure a seal that prevents ice cream from seeping around the side of the piston into the pressure chamber. Until pressurizing fluid is charged into the container. In particular, it is believed that the combination of the very low clearance at the upper edge 32 of the piston and the fact that air is trapped in the recess 36 around the piston prevents any significant amount of ice cream from seeping past the upper edge of the piston.

It is further important that the lower edge 34 of the piston have a small interference fit relationship (for example, three mils on a radius) to the sidewall of the can. It is believed that this arrangement is particularly important when charging pressurized fluid into the lower chamber 24 of the can because it prevents blow-by of fluid into the product. The flexibility of the plastic makes it feasible to employ the interference fit.

Figure 3:
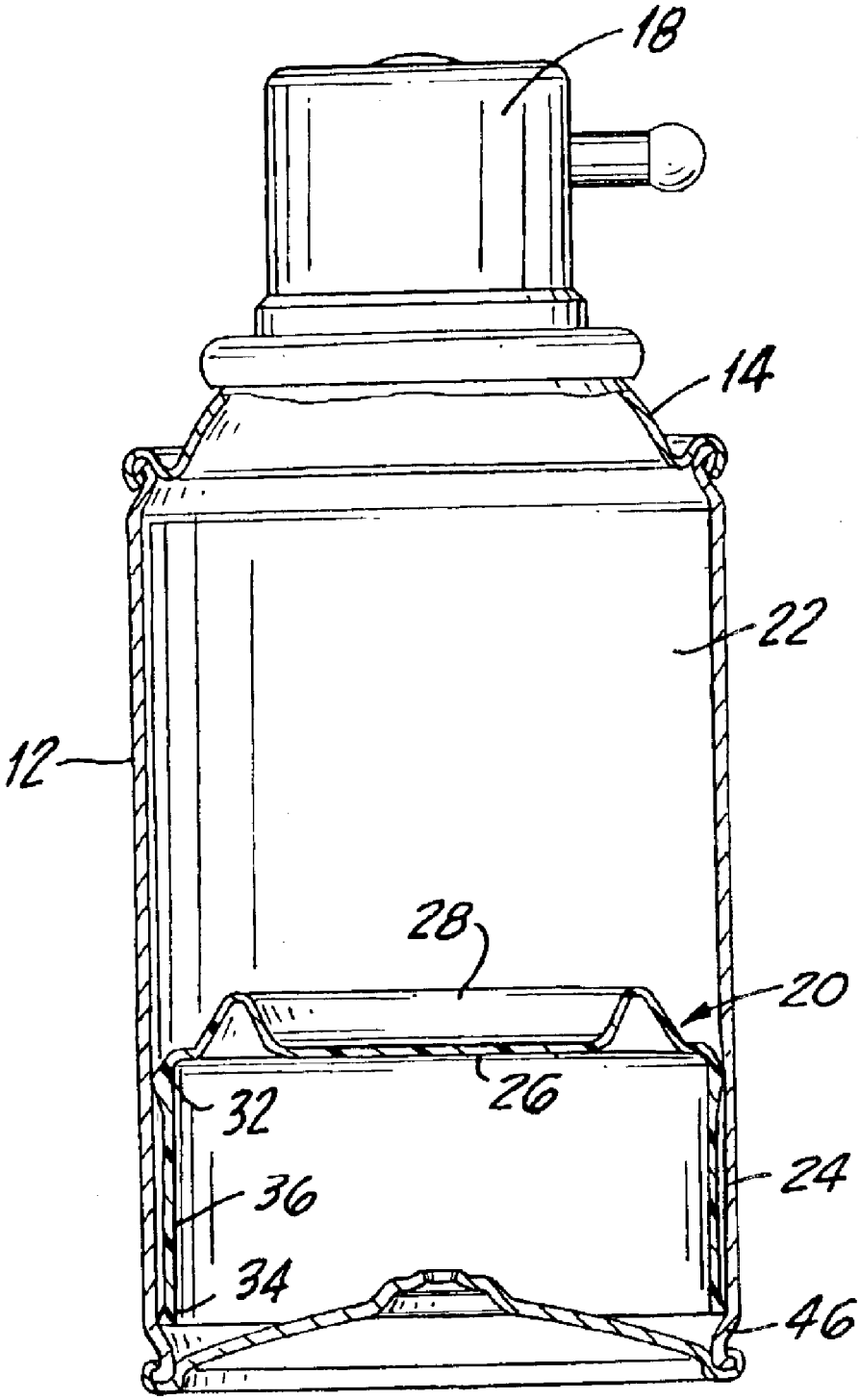
FIG. 3 is a longitudinal sectional view of the FIG. 1 piston and container showing the piston at its downward most position, after product has been loaded, and before propellant has been added.
Figure 4:
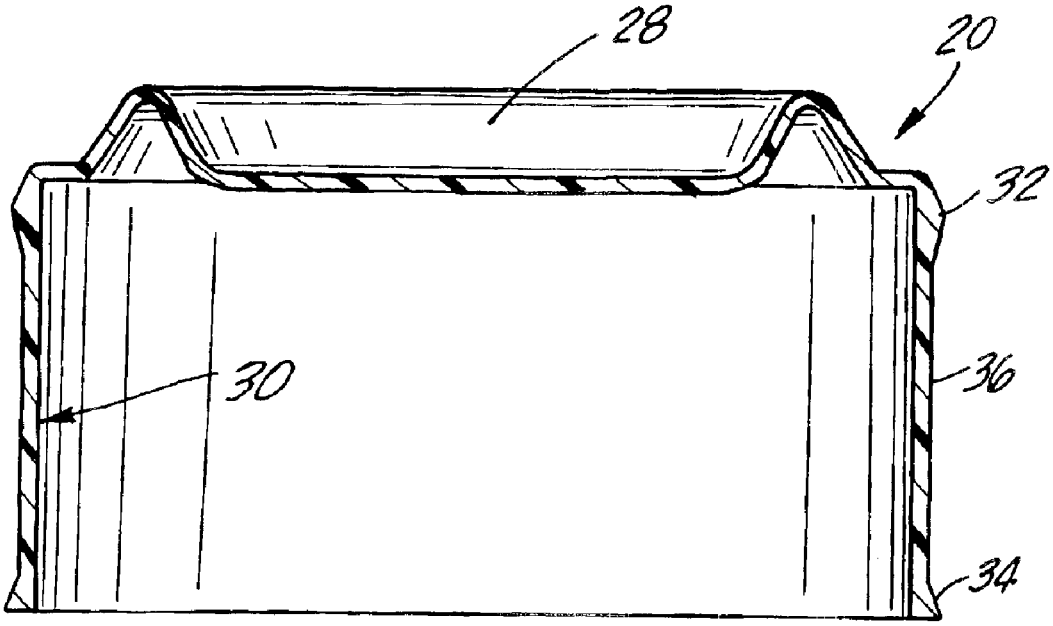
FIG. 4 is a cross-sectional view through the piston of FIG. 1.

As shown in FIG. 3, the container sidewall, is necked-in along its base at the zone 46. This is an increasingly used design. As shown in FIG. 3, the bottom edge 34 of the piston sidewall bottoms out on the curved zone 46 when product is loaded into the container 10. This sloping zone 46 provides an optimum sealing adjustment between the piston bottom edge 34 and container sidewall 12 so that small tolerance variations, particularly in the manufacture of container 10, will not compromise the effectiveness of this interference fit relationship.

It should be recognized in the case where a container does not have this necked-in zone 46, the piston 20 will bottom out on the bottom wall 16 of the container 10. It will be held down under the pressure of the product being loaded so that there will be engagement between the bottom edge of the piston and the bottom of the container as well as an interference fit engagement between the bottom edge of the piston and the sidewall of the container. This provides a sealing feature which compensates for the inevitable tolerance variations in the diameter of the container.

Because of the highly flowable nature of the product when loaded, the gaseous nature of the propellant, and the out of round condition of the container, the sealing is not perfect. There will be seepage of product down along the piston and seepage of propellant up along the piston. By reducing both seepage rates sufficiently, time is bought to complete the product loading stage, the charging stage and the time it takes to freeze the product into a more viscous, hard format. Once the product is so frozen, product will not flow along the piston sidewall and the product will block propellant from entering into the product compartment.

A practical reason why there are significant leakage problems is that the cans are inevitably somewhat out of round and often have a seam. Leakage of flowable product down and propellant up can occur in large part because any nominal clearance or interference between piston and container will vary around the circumference of the container. A piston sidewall having a small clearance will tend to contact the container at high points and provide some gap at other points. Thus, the clearance in a straight wall piston has to be sufficiently great so that some other parameter has to be employed to create a seal between piston and can. The product, if viscous can be used to create that seal. This invention takes the tack of providing a tight fit (that is, small tolerance and small interference) along only the upper and lower edges 32, 34 of the piston 20 and provides a gap 36 along most of the length of the piston wall 30 that, among other things, accommodates this inevitable divergence between the geometry of the piston wall 30 and the geometry of the container wall 12.

Applicant believes that another important feature of this recess 36 is to hold flowable product that seeps past the upper edge 32 seal during the process of loading product. During the subsequent step of charging propellant into the container, the product in the recess 36 will aid in sealing the propellant from migration into product. What Applicant believes happens is that as the piston rises during the stage of charging propellant, the product fills in whatever minor gaps there may be between the lower end 34 of the piston and the out of round and seamed sidewall 12 of the container. Applicant believes that product, even though flowable, is held in the recess 36 by the balance of the pressure from the propellant being charged into the container and the comparable pressure exerted by the product at the top of the piston. Thus, it is assumed, that the product in the gap aids in effecting a seal yet does not flow out of the gap during the course of charging propellant.

Another effect, through probably less important, occurs when product is held in the recess 36 after the frozen product is allowed to melt. Under that condition, there is a chance of propellant blow by. It is believed that product in the gap between the top and bottom edges of the piston aids in enhancing the seal that prevents blow by.

It is important to recognize that the ability of the piston to perform the functions required in this context requires a combination of the features of: low clearance upper end, interference fit lower end, and a substantially larger clearance between those two ends. The effectiveness of the piston to achieve the end result requires in part at least that the process of loading product and charging the container be undertaken rapidly so that the product can be put into its frozen (that is, highly viscous) state, which state prevents both product and propellant migration along the sidewall of the piston. The design of this piston recognizes that a piston structure which keeps migration of product and migration of propellant at a minimum during the loading and charging steps provides an intermediate state which then can be rapidly brought down to the kind of low temperature which prevents further migration. In effect, the design of this invention buys time for the completion of the operation.

In one embodiment, the ice cream is loaded at a temperature of approximately 30° Fahrenheit. When frozen, it is at a temperature of approximately zero degrees Fahrenheit.

The piston design with a recess 36 between the upper 32 and lower edges 34 of the sidewall has been tested in a pressurized container used to dispense ice cream which is maintained in a freezer between the time when the container is filled and charged and the time when the product is discharged. It has the advantages outlined above.

In addition, Applicant believes, but cannot be certain, that the piston design may provide advantages for one or more of the following reasons.

During discharge, it seems inevitable that a thin film of product will be left along the sidewall of the can as product is dispensed. If the can were then refrozen because not all of the product was dispensed at one time, the film of ice cream would refreeze. In that case, if the piston did not have the recess 36, there would be a risk that the refrozen ice cream would bind the entire piston wall to the can and make it difficult to continue with the discharging of product after refreezing.

In the design described above, this risk is avoided because the only area where such binding of refrozen product would occur is along the upper edge of the piston and the limited zone of frozen product could readily be broken by the pressure applied 35 psig to 125 psig.

The interference fit of the lower edge 34 of the piston sidewall may be of value in reducing the risk of bypass or blow-by in case the piston gets stuck during dispensing. If the piston gets stuck during dispensing, the edge 34 may engage the sidewall of the can thereby preventing the pressurizing gas from passing between the piston and can and thus minimizing the risk of blow-by.

This piston is particularly designed to be used for product, such as ice cream, which is loaded into the dispensing container before being frozen and then immediately frozen. When being dispensed, the ice cream is much less flowable than, for example, silicone or caulk. Thus for dispensing ice cream, a larger diameter dispensing valve is required. Further, during dispensing the ice cream is less likely to seep or flow down around the piston sidewall than are product which is not frozen before discharge.

In one specific embodiment having the FIG. 3 configuration, the piston has the following dimensions and, during loading and charging, the following bogie clearance characteristics when employed with a container having a sidewall with a 2.575 bogie inch inner diameter:

piston upper edge 32 diameter: 2.567 inches.

upper edge 32 clearance: 4 mils on a radius.

piston lower edge 34 diameter: 2.580 inches.

lower edge 34 interference: 2.5 mils on a radius.

recessed zone 36 diameter: 2.456 inches at minimum point.

recessed zone 36 clearance: up to 15 mils on a radius.

piston 30 wall thickness: 35 to 40 mils.

In this specific embodiment, the lower edge 34 has a radius that is 6.5 mils greater than the radius of the upper edge 32. Thus, the lower edge 34 has a diameter that is 13 mils greater than that of the upper edge 32.

Applicant believes, depending in large part on the tolerances that can be maintained for the container sidewall, and in part on the nature of the product being loaded, and the speed during which the product loading and propellant charging states can be effected, that the radial clearance at the upper edge 32 can be anywhere between 3 mils and 7 mils on a radius and that the radial interference at the lower edge 34 can be anywhere between 2 mils and 5 mils. With such a range, it can be that the piston at the lower edge 34 has a radius as much as 12 mils greater than the piston radius at the upper edge. In other cases, the piston lower edge can have a radius as little as 5 mils greater than the piston radius upper edge. Thus, it is believed that the lower edge 34 piston diameter could range between 10 and 24 mils greater than the upper edge 32 piston diameter.

After product has been loaded and propellant is charged into the container, the temperature of product may be reduced from approximately 30° Fahrenheit to approximately zero degrees Fahrenheit. The dimensions recited above are at a room temperature of approximately 60° to 70° Fahrenheit. The shrinkage of the piston and of the can that occurs as the temperature of the can and its contents is brought down to zero degrees Fahrenheit will change those tolerances materially. The clearance at the upper end of the piston might double. The interference at the base of the piston might go to zero. But under those conditions, the relative solidity of the material being dispensed serves to prevent seepage of product down along the sidewall of the piston or leakage of propellant into the product.

Figure 5:
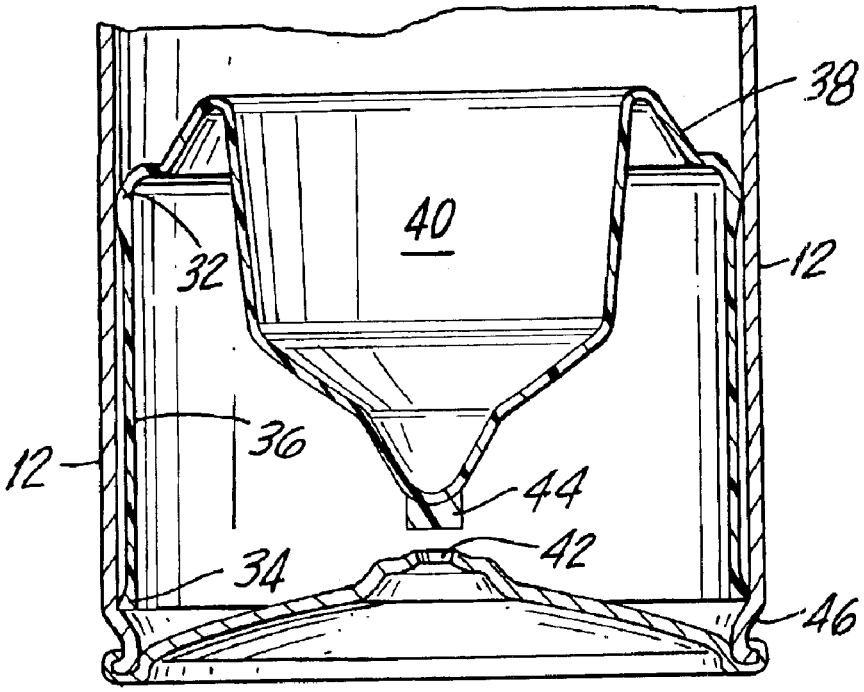
FIG. 5 is a cross-sectional view of a second embodiment of the piston of this invention. This piston embodiment has a deep central well to accommodate a valve. It shows the piston in its downward most position.
Figure 6:
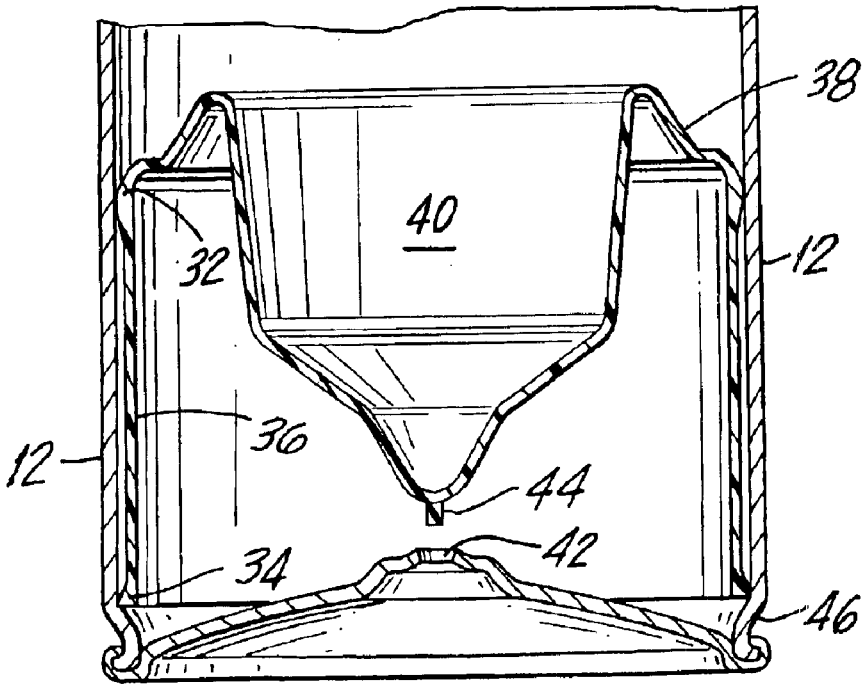
FIG. 6 is a view along the plane 6—6 of FIG. 5 showing the rib having a thickness substantially less than the diameter of the container base opening to which it is adjacent.

The second embodiment shown in FIGS. 5 and 6 is to a piston which has been designed for an ice cream dispensing container having a valve that extends down into the body of the container. Thus, the piston has to have an unusually deep well 40. When the product has been loaded and the piston is down against the bottom of the container, the lower end of the well 40 might abut against the small opening 42 in the bottom 16 of the container and block the charging of propellant through the opening 42. To minimize that risk, this embodiment of the piston 38 has a small rib 44 which has a width of 20 mils. The opening 42 has a diameter of 140 mils. Thus, if the lower edge of the piston well does hit against the opening 42, the rib 44 will avoid blocking that opening and thus the charging stage can be effectively undertaken.

While the foregoing description and drawings represent the presently preferred embodiments of the invention, it should be understood that those skilled in the art will be able to make changes and modifications to those embodiments without departing from the teachings of the invention and the scope of the claims.

What is claimed is:

1. A piston adapted to be used in a pressurized dispensing container for dispensing product that is loaded into the container under pressure and which product is substantially more flowable when loaded into the container than when dispensed, comprising:

an annular sidewall having an upper end and a lower end, said upper end of said piston sidewall being substantially rigid and having a first outer diameter to provide a clearance with the wall of the container with which it is designed to be used, said first clearance being small enough to aid in maintaining an effective seal during loading of product into the container yet large enough to permit piston movement under pressure during dispensing, said lower end of said piston sidewall having a second outer diameter to provide an interference fit with the wall of the container, said interference fit being small enough to permit piston movement under pressure during dispensing, said first small clearance at said upper end and said interference fit at said lower end cooperating to minimize product leakage past said upper end during loading, said interference fit at said lower end being adequate to minimize by-pass during charging of propellant into the container, at least a major portion of said piston sidewall between said upper end and said lower end has an outer diameter less than said first and second outer diameters to provide a recess between said upper and lower ends, the primary component of frictional resistance to movement of the piston in the container during the dispensing of product is the degree of engagement between said upper and lower ends of said piston sidewall and the sidewall of the container.

2. The piston of claim 1 wherein:

said piston upper end clearance is approximately four mils on a radius, and said piston lower end has an interference fit of approximately two to three mils on a radius.

3. The piston of claim 2 wherein: said piston recess provides approximately between ten and twenty mils clearance with the wall of the container.

4. The piston of claim 1 wherein: the thickness of said sidewall is approximately between 35 and 40 mils.

5. The piston of claim 2 wherein: the thickness of said sidewall is approximately between 35 and 40 mils.

6. The piston of claim 3 wherein: the thickness of said sidewall is approximately between 35 and 40 mils.

7. The piston of claim 1 wherein: said piston is polypropylene.

8. The piston of claim 4 wherein: said piston is polypropylene.

9. The piston of claim 6 wherein: said piston is polypropylene.

10. The piston of claim 1 wherein: said recess constitutes more than 90% of the height of said piston sidewall.

11. The piston of claim 2 wherein: said recess constitutes more than 90% of the height of said piston sidewall.

12. The piston of claim 3 wherein: said recess constitutes more than 90% of the height of said piston sidewall.

13. The piston of claim 6 wherein: said recess constitutes more than 90% of the height of said piston sidewall.

14. The piston of claim 9 wherein: said recess constitutes more than 90% of the height of said piston sidewall.

15. A piston adapted to a pressurized dispensing container for dispensing product that is loaded into the container under pressure and which product is substantially more flowable when loaded into the container than when dispensed, comprising:

an annular sidewall having an upper end, a lower end and a center zone, said upper end of said piston sidewall being substantially rigid and having a predetermined outer diameter, said lower end of said piston sidewall having an outer diameter that is between approximately 10 mils and 15 mils greater than said predetermined outer diameter of said upper end, said center zone constituting at least a major portion of said piston sidewall between said upper end and said lower end having an outer diameter that is at least 10 mils less than said predetermined outer diameter of said upper end, thereby providing a recessed zone between said upper end and said lower end.

16. The piston of claim 15 wherein: said lower end has a diameter that is approximately 13 mils greater than the diameter of said upper end.

17. The piston of claim 15 wherein: said lower end has a diameter that is approximately between ten mils and 24 mils greater than the diameter of said upper end.

18. The piston of claim 15 wherein: said upper end provides a radial clearance of approximately four mils when product is loaded into the container.

19. The piston of claim 18 wherein: said lower end has a diameter that is approximately 13 mils greater than the diameter of said upper end.

20. The piston of claim 18 wherein: said lower end has a diameter that is approximately between ten mils and 24 mils greater than the diameter of said upper end.

21. The method of loading product and charging propellant into a piston operated pressurized dispensing container comprising the steps of:

providing a first close clearance between the top of the sidewall of the piston and the container wall, providing a small interference fit between the bottom end of the sidewall of the piston and the container wall, said top end clearance and bottom end interference cooperating to substantially prevent product from seeping past said top end during the loading process, and reinforcing the sealing provided by said interference fit during the product loading stage by forcing said lower end of said piston down against a lower surface of the container.

22. The method of claim 20 wherein said reinforcing Step includes forcing said lower end of said piston against an angled surface at the lower end of said container.

23. The method of claim 22 wherein said reinforcing step involves forcing said lower end of said piston against an angled surface at the lower end of the container.

* * * * *